US007074443B2

(12) United States Patent
Thomas et al.

(10) Patent No.: US 7,074,443 B2
(45) Date of Patent: Jul. 11, 2006

(54) VENTED CAN OVERCAP

(75) Inventors: Jeffrey A. Thomas, Cortlandt Manor, NY (US); Jeffrey Alan Zimmermann, Purdys, NY (US); Piras DeCleir, Sleepy Hollow, NY (US); Mete Bruncaj, Briarcliff Manor, NY (US)

(73) Assignee: Kraft Foods Holdings, Inc., Northfield, IL (US)

( * ) Notice: Subject to any disclaimer, the term of this patent is extended or adjusted under 35 U.S.C. 154(b) by 348 days.

(21) Appl. No.: 10/298,565

(22) Filed: Nov. 19, 2002

(65) Prior Publication Data

US 2004/0096552 A1 May 20, 2004

(51) Int. Cl.
*B65D 51/16* (2006.01)

(52) U.S. Cl. ..... 426/118; 426/131; 426/595; 220/203.01; 220/203.29

(58) Field of Classification Search ..... 426/106, 426/118, 131, 395, 594–595; 220/202, 203.01, 220/203.09, 203.29
See application file for complete search history.

(56) References Cited

U.S. PATENT DOCUMENTS

| | | | | | |
|---|---|---|---|---|---|
| 933,103 | A | * | 9/1909 | Norton | 220/373 |
| 1,766,173 | A | * | 6/1930 | Hills | 53/432 |
| 1,857,015 | A | * | 5/1932 | Gere | 215/260 |
| 2,054,094 | A | * | 9/1936 | Murch | 220/800 |
| 3,077,409 | A | * | 2/1963 | Baselt | 426/118 |
| 3,613,938 | A | * | 10/1971 | Westcott | 220/785 |
| 3,799,427 | A | * | 3/1974 | Goglio | 383/103 |
| 3,850,330 | A | | 11/1974 | Koontz et al. | |
| 4,210,255 | A | * | 7/1980 | Pan | 220/203.15 |
| 4,213,537 | A | * | 7/1980 | Caccavale | 220/215 |
| 4,234,100 | A | | 11/1980 | Chabot | |
| 4,315,578 | A | | 2/1982 | Ludwig, Jr. | |
| 4,444,219 | A | * | 4/1984 | Hollenstein | 137/246 |
| 4,522,298 | A | * | 6/1985 | Weinberger | 206/216 |
| 4,705,188 | A | * | 11/1987 | Rahn | 220/366.1 |
| 5,242,069 | A | * | 9/1993 | Hertrampf | 215/260 |
| 5,445,291 | A | * | 8/1995 | Daniel | 220/366.1 |
| 5,558,243 | A | | 9/1996 | Chu | |
| 5,688,544 | A | | 11/1997 | Bolton et al. | |
| 5,692,632 | A | | 12/1997 | Hsieh et al. | |
| 5,782,266 | A | * | 7/1998 | Domke | 137/551 |
| 5,992,442 | A | * | 11/1999 | Urquhart et al. | 137/246 |
| 6,068,154 | A | | 5/2000 | Grabher | |
| 6,089,271 | A | * | 7/2000 | Tani | 137/854 |
| 6,662,827 | B1 | * | 12/2003 | Clougherty et al. | 137/859 |

FOREIGN PATENT DOCUMENTS

EP 0 638 274 A1 5/1994

* cited by examiner

*Primary Examiner*—Drew Becker
(74) *Attorney, Agent, or Firm*—Stites & Harbison PLLC, Marvin Petry

(57) ABSTRACT

Packaging for a can containing ground roasted coffee packed under atmospheric pressure and having a flexible peel-off lid which is vented to allow the escape of a buildup of carbon dioxide gases. A spacing structure prevents the vent valve in the lid from being closed by contact with the plastic overcap. The spacing structure may include bosses on the overcap which engage the vent valve or a pocket in the overcap which allows the flexible lid to reach a maximum height without engaging the overcap. A permanently opened passageway may be provided between the plastic overcap and the rim of the can to further facilitate the escape of carbon dioxide.

25 Claims, 6 Drawing Sheets

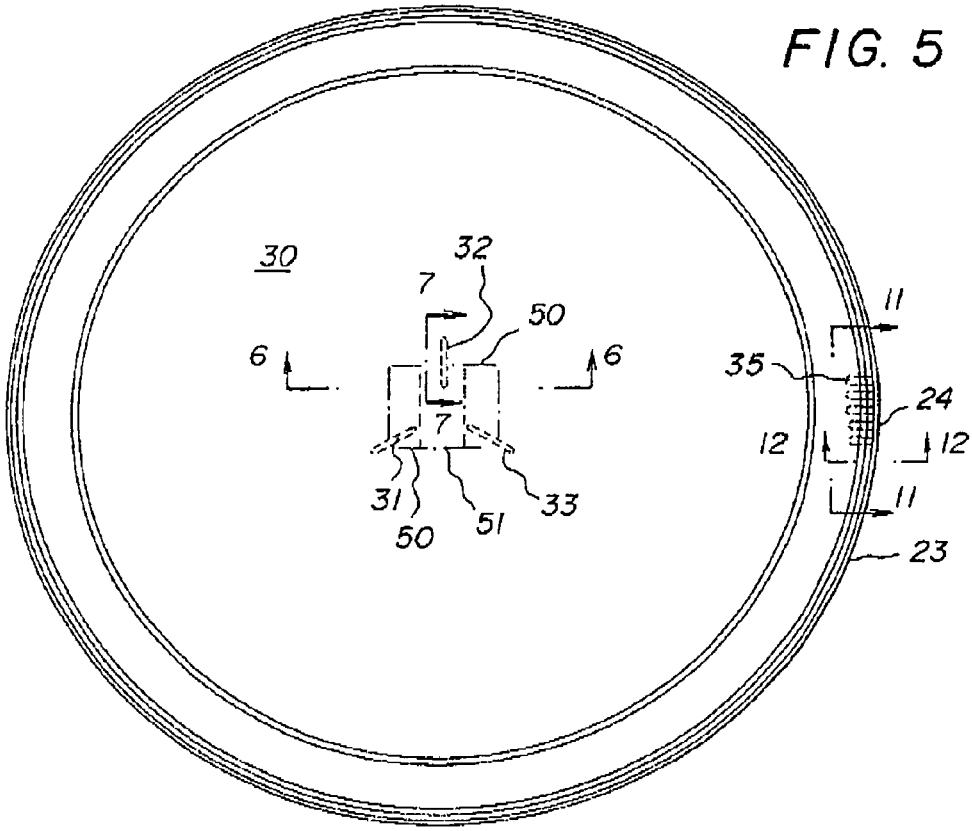
FIG. 5
FIG. 6
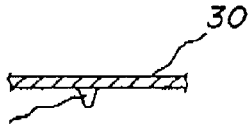
FIG. 7
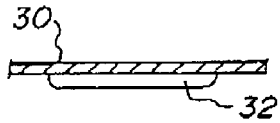
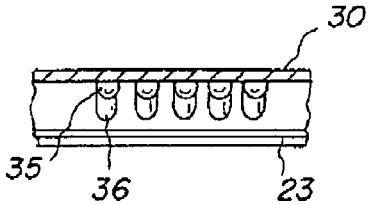
FIG. 11
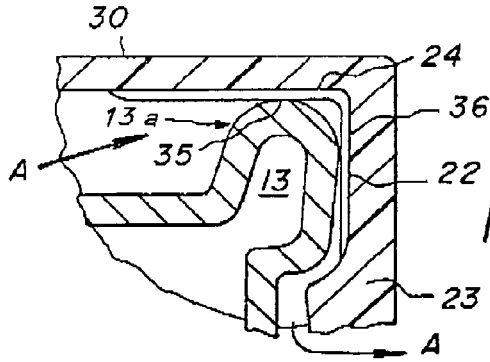
FIG. 12

VENTED CAN OVERCAP

FIELD OF THE INVENTION

This invention relates to a canned product which generates a gaseous pressure buildup, and to an improved arrangement for venting such gases.

BACKGROUND OF THE INVENTION

Historically, ground roast coffee packaged in a can has been vacuum packed. Recently, it has been found desirable to freshly package roast ground coffee in cans or other rigid or semi-rigid gas impervious packages under atmospheric pressure as contrasted to the prior vacuum packaged cans. Additionally, it has also been found desirable to close off the top of the can with a flexible peel-off easy opening seal or lid, whether the coffee was packed under a vacuum or atmospheric pressure. Examples of such peel-off easy opening lids are shown in the Bolton et al U.S. Pat. No. 5,688,544.

Packaged ground roast coffee gives off carbon dioxide which, in a sealed confined space will generate a pressure buildup within the container. In the case of vacuum packed ground roast coffee, this generation of carbon dioxide causes no problem because the pressure buildup simply tended to reduce the negative pressure within the sealed container. However, if the product is freshly packaged initially at atmospheric pressure without extensive degassing, then generated carbon dioxide will cause a pressure buildup in the can above atmospheric pressure. In atmospheric pressure packed ground roasted coffee cans now on the market, this pressure buildup caused by the generated carbon dioxide is dealt with by simply placing a vent valve in the top of the can. If the can is of a type having a flexible peel-off seal, the vent valve will be built directly into the flexible peel-off lid.

It is also highly desirable, if not a commercial necessity, to include with any coffee can a plastic overcap which is intended primarily to protect the coffee product within the package after the main airtight seal has been opened.

A problem has developed, however, in the case of a ground roast coffee can having a vented peel-off lid and a plastic overcap. It has been found that as the gas pressure builds up within the can it tends to dome the flexible lid upwardly and eventually against the overcap. This creates several problems. First, the constant extension of the flexible lid in its domed condition deforms the flexible lid, causing a wrinkled appearance which is unacceptable to the consumer. Additionally, the materials used to seal the vent valve to the lid, including silicon-based oils, would tend to be expelled from the valve opening and onto the surface of the overcap. This causes a visual blemish which is also unacceptable to the consumer. Additionally, if the valve is sufficiently blocked, the gas within the can can cause the can itself to bulge outwardly, which again is unacceptable to the consumer.

While a primary problem has been blockage of the vent valve in the flexible easy-off lid, an additional problem arises in that gases which do escape through the lid may not be able to escape from the space between the lid and the overcap. It is true that the overcap is simply snapped over the chime of the can in a non-airtight manner. However, the surfaces of the overcap which engage the chime of the can, generally along the top and outer periphery of the chime, while not forming a hermetic seal, clearly form a closure which resists escape of any generated gases which might exit from the vent valve into the space between the lid of the can and the overcap.

Thus, a need exists for an improved arrangement for venting gases created within a can wherein the product is packed under atmospheric pressure and is of the type which generates gases sufficiently to cause a pressure buildup, especially when such a can is used in combination with an overcap.

BRIEF SUMMARY OF THE INVENTION

It is a purpose of the present invention to provide a new and improved arrangement for venting gases which build up in a package of the type wherein the product is packaged under atmospheric pressure in a can having a flexible lid with a vent valve and an overcap. More specifically, it is the purpose of the present invention to provide such an improvement for the fresh packaging of ground roast coffee in a can under atmospheric pressure. The term "can" is intended to encompass various types of containers and packages, including the usual cylindrical metallic can as well as rectangular cans, thin metallic cans of any shape and non-metallic cans.

In accordance with the present invention, an arrangement is provided for preventing the vent valve to be closed off by contact with the overcap. This arrangement comprises a spacing structure preferably formed in or on the bottom of the overcap, which prevents the vent valve in the lid from being closed by contact with the plastic overcap. In one preferred embodiment, this is achieved by providing bosses on the lower, internal surface of the overcap which will engage the flexible lid as it moves upwardly so as to limit such upward movement to such a height that the vent valve remains unblocked and the vented gases are permitted to flow therethrough. Preferably the bosses engage the vent valve in such a way as to block its upward movement while not occluding the vent valve opening. The bosses can take many different shapes such as thin ribs, rectangular cross sections and the like.

In another preferred embodiment, the spacing structure may take the form of a pocket formed in the bottom of the overcap and of such a depth that it allows the flexible lid to reach its maximum height caused by the gas buildup without the flexible lid or the vent valve engaging the overcap.

Additionally, the present invention may include a permanently open passageway at the interface between the overcap and the chime of the coffee can which will allow the escape of any built-up gases which have passed through the vent valve into the space between the flexible lid and the overcap.

In a preferred embodiment, this permanently open passageway between the overcap and the chime of the can can be provided by providing some raised bosses on the inside surface of the plastic overcap precisely where it engages the chime of the can. A series of such bosses, arranged side-by-side, would thereby provide a permanently open passageway between the bosses.

Thus, it is an object of the present invention to provide a new and improved arrangement for venting built-up gases in a can containing a product which generates gases and which can includes a flexible lid and an overcap.

It is another object of the present invention to provide a new and improved arrangement for venting gases from a can of the type described which includes a structure for preventing blockage of a vent valve in the flexible lid.

It is still another object of the present invention to provide an improved venting arrangement in a package of the type described which includes a structure for forming a permanently open passageway between the interface of the overcap and the chime of the coffee can.

These and other objects of the present invention will become apparent from the detailed description of the preferred embodiments.

BRIEF DESCRIPTION OF THE DRAWINGS

Preferred embodiments of the present invention are illustrated in the accompanying drawings, wherein:

FIG. 5 is a top plan view of the overcap of FIG. 4;

FIG. 6 is a partial cross sectional view taken along line 6—6 of FIG. 5;

FIG. 7 is a partial cross sectional view taken along line 7—7 of FIG. 5;

FIG. 11 is a partial cross sectional view taken along line 11—11 of FIG. 5; and FIG. 12 is an enlarged view of the upper right-hand portion of FIG. 4, more clearly illustrating certain features of the present invention.

DETAILED DESCRIPTION OF THE PREFERRED EMBODIMENTS

Figure 1:
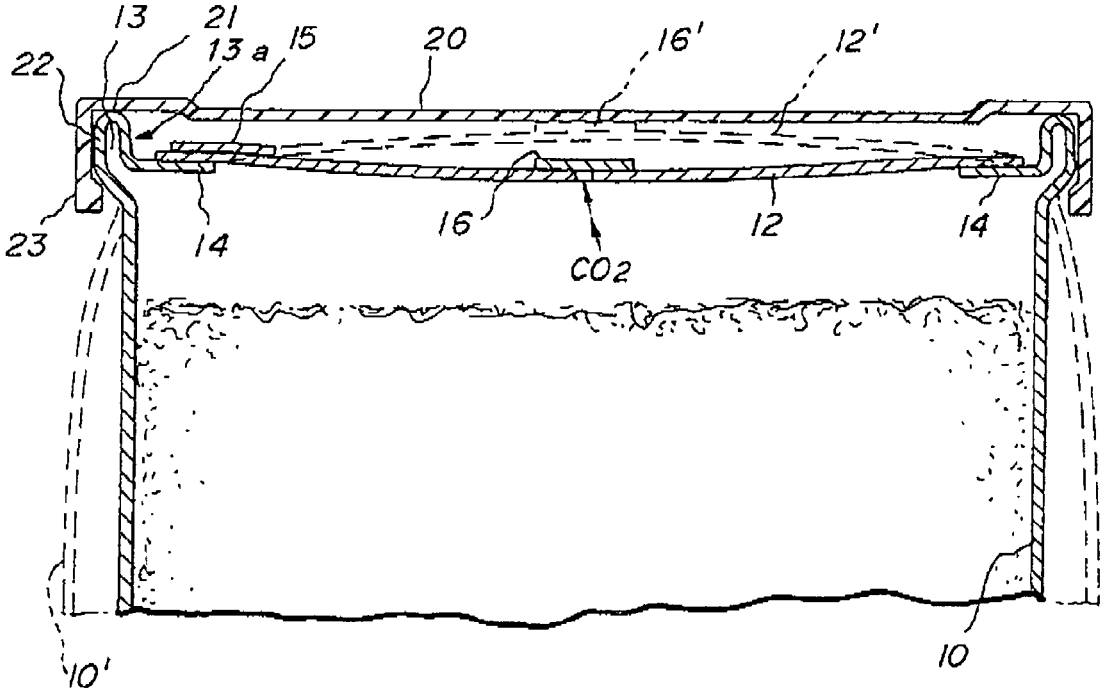
FIG. 1 PRIOR ART
FIG. 1 is a cross sectional view through a prior art package illustrating the problem solved by the present invention.

Referring now to the drawings, like elements are represented by like numerals throughout the several views.

FIG. 1 illustrates a conventional can 10 which packages a product 11, for example ground roast coffee, under atmospheric pressure. The normal condition of the can is shown in solid lines. The top of the can is sealed by a flexible peel-off lid 12 formed of a flexible foil material, which lid is hermetically sealed around its periphery to a ledge 14 which is integral with the can 10. In a manner known per se, the easy peel-off lid 12 has a pull tab 15. When a product such as ground roasted coffee is packaged at atmospheric conditions, the carbon dioxide which is naturally given off by the product will cause a gaseous buildup within the interior of the can 10. It is therefore necessary to provide a vent in the form of a vent valve 16 which will permit the built-up carbon dioxide to escape to the space above the flexible lid 12.

A conventional can includes a chime 13 with inner edge 13*a* and a plastic overcap 20. The overcap engages the chime at contact lines 21 and 22. While these contact lines are not intended to provide a hermetic seal, they do to some extent restrict the flow of gas. The primary purpose of the overcap is to provide some protection for the product after the lid 12 has been removed. The overcap 20 also includes a lower part 23 which hangs below the chime and is not in contact with it.

The can 10 may be of any suitable material such as metal, plastic, composite materials, cardboard or other suitable materials. Between the time that a can such as that shown in FIG. 1 is initially sealed, until the time that the consumer removes the lid 12, carbon dioxide is being generated within the hermetically sealed interior of the can. Initially, as the carbon dioxide tries to escape through the vent valve 16, the resistance offered by the vent valve 16 would be greater than the resistance offered to upward bending of the flexible lid 12. Eventually, the condition is reached as shown in dotted lines in FIG. 1 whereat the flexible lid 12 has been moved up to a domed position 12' and the vent valve 16 has been moved up against the bottom of the overcap 20 as shown at 16'. At this point, the downward force of the overcap would tend to close off the vent valve 16. This presents two problems. First, the lid 12 will remain in the domed position 12' and thus become deformed, causing a wrinkled appearance which is not acceptable to the consumer. Second, if the vent valve 16 includes a silicone-based oil, such oil will be expelled from the valve and onto the overcap 20. This causes a stain which tends to spread, causing a visual blemish. Additionally, in the case of rectangular cans, thin metallic cans of any shape, and non-metallic cans, a further buildup could cause the sides of the can 10 to bulge outwardly, as represented by dotted lines 10'. Such a bulged out can is also unacceptable to the consumer.

Figure 2:
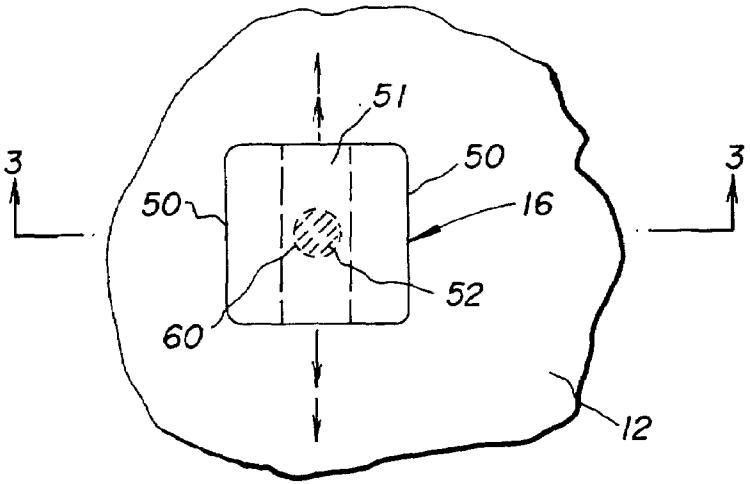
FIG. 2 PRIOR ART
FIG. 2 is a plan view of the vent valve on the flexible lid of FIG. 1.

The vent valve is a commercial product made by Plitek, LLC. Referring to FIG. 2, the vent valve is divided into two outer portions 50 which are completely adhered to the top of lid 12 and a central portion 51 which includes a channel therein for the flow of the built-up gases out both ends of the channel, as shown by the arrows in FIG. 2.

Figure 3:
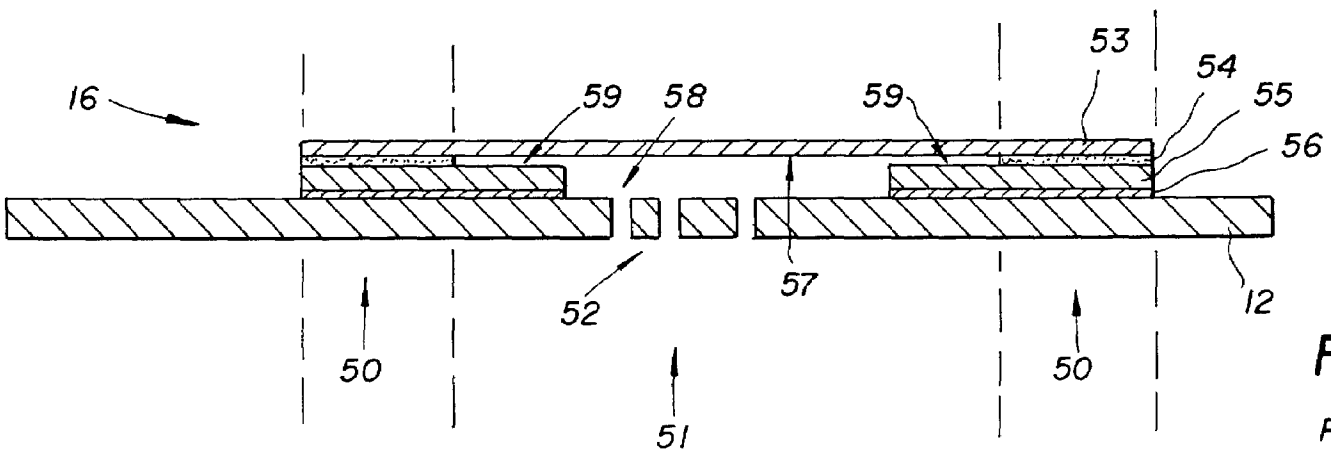
FIG. 3 PRIOR ART
FIG. 3 is a greatly enlarged cross sectional view of a vent valve of FIGS. 1 and 2, taken along line 3—3 of FIG. 2.

The valve 16 is shown in greater detail in FIG. 3. The flexible lid 12 would preferably have openings formed therein in the form of slits 52 of a type as shown in FIG. 14 of the Bolton U.S. Pat. No. 5,688,544. The width of the slits is highly exaggerated in greatly enlarged FIG. 3. In practice, there could be approximately seven small slits, all located in the central portion of the vent valve 16. FIG. 2 illustrates a plurality of slit openings in the lid 12 within a central area designated at 60. Referring to FIG. 3, the vent valve 16 includes an upper membrane 53 of metallic polyethylene terephthalate (PET). Below the membrane 53 is a polyethylene terephthalate valve flap 57 which is adhered by synthetic rubber adhesive 54 to a natural PET base 56 which is in turn adhered to the flexible lid 12 by a pressure sensitive adhesive 56. The inner space between the valve flap 57 and the flexible lid 12 just above the slits 52 is filled with a silicone-based oil with graphite suspension. In practice, gas escaping through the flexible lid 12 will flow through an opening in the valve flap 57 and then outwardly through the ends of central portion 51 between the valve flap 57 and the membrane 53. The portions 50 and 51 are indicated by vertical dotted lines in FIG. 3.

Solutions to the problem described above are illustrated in FIGS. 4–12.

Figure 4:
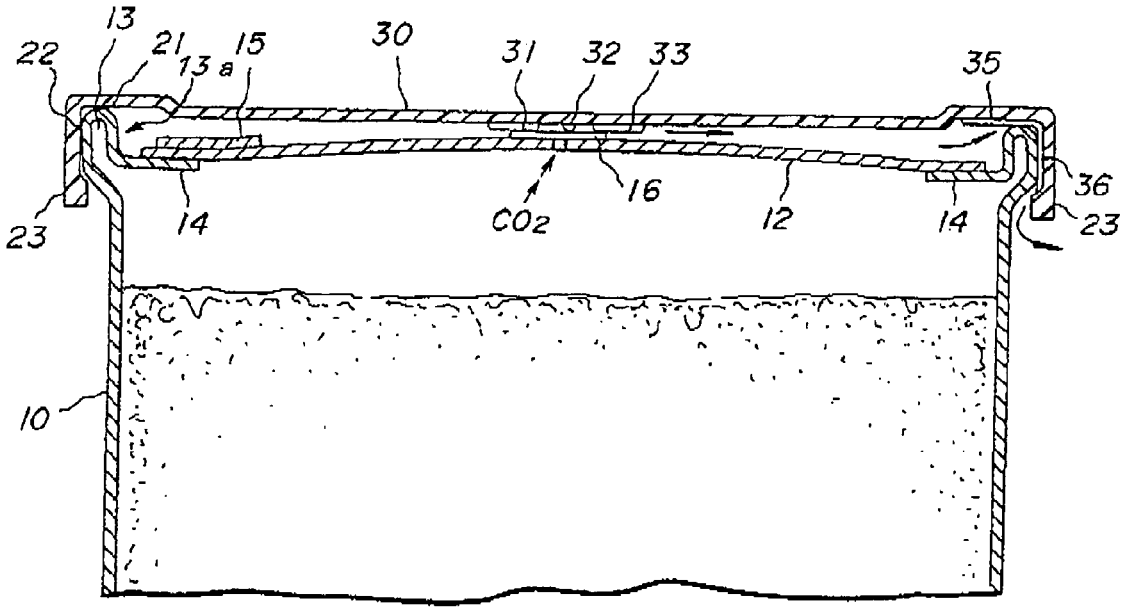
FIG. 4 is a cross sectional view through a package, similar to FIG. 1, but showing the features of the present invention.

Referring to FIGS. 4–7, there is provided an overcap 30. A vent valve 16 of the type described in FIGS. 2 and 3 is superimposed in dotted lines on FIG. 5. Formed on the underside of the overcap 30 (and referring also to FIGS. 6 and 7, there are provided a plurality of thin rib bosses 31, 32 and 33. Referring to FIGS. 4 and 5, a highly domed position of the lid 12, the vent valve 16 will engage the thin rib bosses 31, 32 and 33, thus keeping the vent valve 16 spaced beneath the actual undersurface of the overcap 30. By providing three bosses 31, 32 and 33, and by placing them at 120° from each other around the center of the overcap, it is assured that at any given rotational position, while one of the thin ribs might well engage and prevent gas from flowing through one end of the central channel portion 51, the other end thereof will always be unobstructed for the flow of the escaping built-up gases.

The rib bosses 31–33 are all identical, and one of them is shown in detail in FIGS. 6 and 7. In a preferred embodiment, each rib boss would have a thickness of approximately 0.01 inches, a height of 0.04 inches and a width at its bottom of approximately 0.01 inches.

Figure 8:
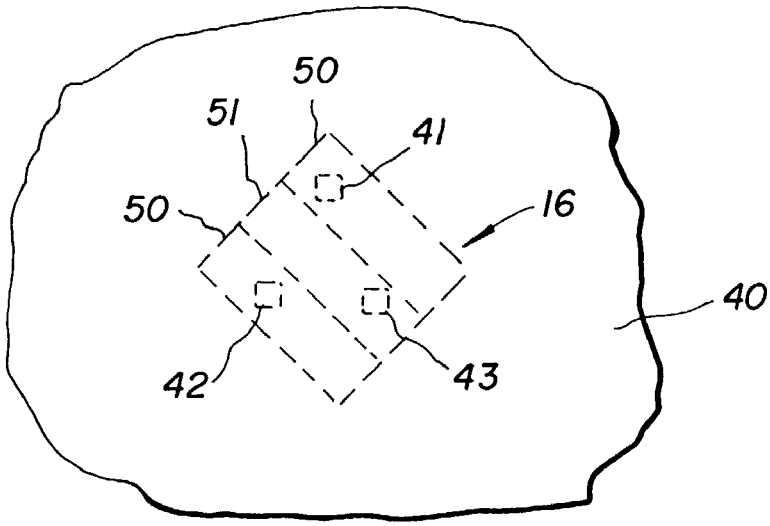
FIG. 8 is a partial plan view of an overcap similar to FIG. 5 but showing a modification of the present invention.

FIG. 8 illustrates a modification of the present invention. In this case, there is provided an overcap 40 which differs from the overcap 30 in that the thin rib bosses 31, 32 and 33 have been replaced by square cross section bosses as shown at 41, 42 and 43 in FIG. 8. These could for example have a side dimension of 0.06 inches and a depth, the same as in FIGS. 4–7, of approximately 0.04 inches. The bosses may also have other polygonal or round shapes. Referring to FIG. 8, it is noted that the three bosses 41, 42 and 43 are arranged in a triangular pattern, equiangularly about the axis of the overcap 40. Here, the vent valve 16 is turned relative to its orientation in FIGS. 4 and 5. However, owing to the arrangement of the bosses 41, 42 and 43, even though one of them, in this case 43, engages the central portion 51, the other two bosses 41 and 42 are so situated as to permit gas to flow out through the other end of central portion 51.

In the package of FIG. 4, the flexible lid 12, upon original sealing of the can, would be in the downwardly curved position as shown in solid lines in FIG. 1. However, FIG. 4 is intended to illustrate in solid lines only the position when the carbon dioxide has caused sufficient upward movement of the flexible lid 12 to the height whereat the vent valve 16 has engaged the bosses 31, 32 and 33.

Figure 10:
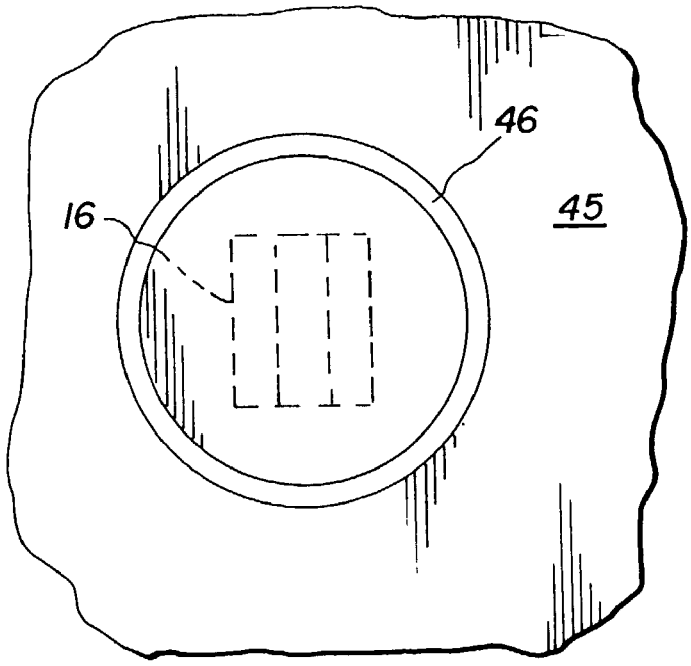
FIG. 10 is a partial plan view of the overcap of FIG. 9.
Figure 9:
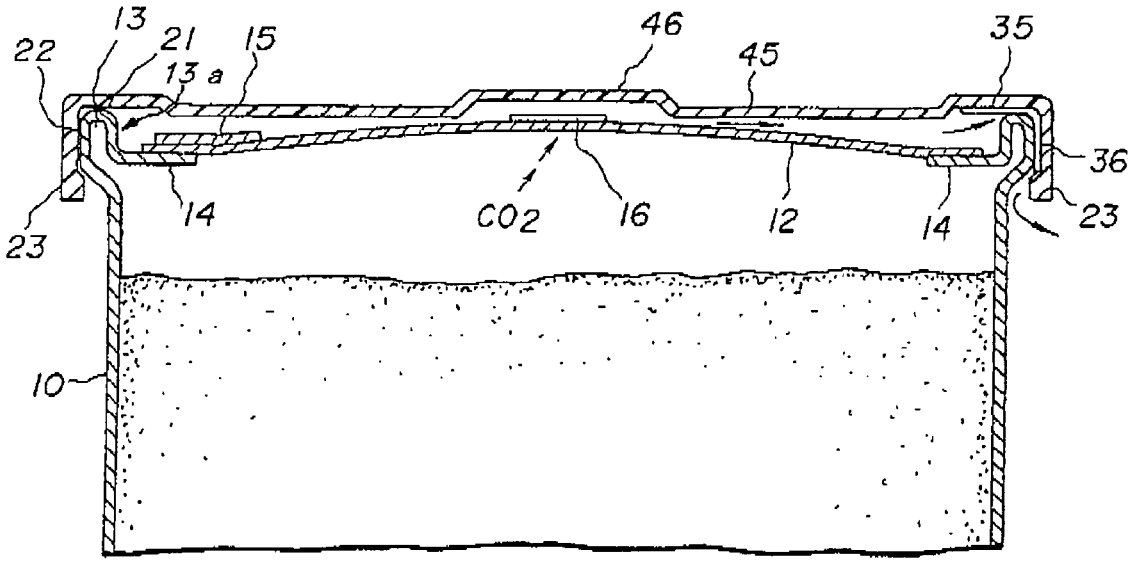
FIG. 9 is a cross sectional view through a package, similar to FIG. 4, but showing a modification of the present invention.

FIGS. 9 and 10 illustrate another embodiment of the present invention. In this embodiment, an overcap 45 includes a pocket 46 which is sufficiently deep that the vent valve 16, even in its uppermost domed position, will never engage the bottom of pocket 46 and hence will not engage the bottom of overcap 45. The location and depth of pocket 46 must be selected so that in the uppermost position of the lid 12 and valve 16, there is an open passageway through the vent valve 16, below the edges of the pocket 46 and out toward the periphery of the can. The pocket would preferably have a height of between ⅛ and ¼ inch.

As noted above, the contact lines 21 and 22 between the chime of the can and the interior of the overcap 30, 40, 45, while not forming a hermetic seal, do offer some resistance to the flow of gases. Referring to FIGS. 11 and 12, with the vent valve 16 unblocked (by the use of bosses 31–33 or 41–43, or pocket 46), permitting free flow of the carbon dioxide out of the can and into the space between the flexible lid 12 and the overcap 30, 40, 45, it is possible that the gases can build up to a pressure sufficient to pass beyond contact lines 21 and 22. However, in order to facilitate the flow of gases out of the space between the overcap 30, 40, 45 and the lid 12, the present invention further includes providing a permanently opened passageway from this inner space to the surrounding exterior. For this purpose, raised elongated bosses 35 and 36 are provided on the top and side of the interior of the overcap 30, 40, 45 where the overcap engages the chime 13 at contact lines 21 and 22. Gases entering this inner space between lid 12 and overcap 30, 40, 45 now have a permanently opened passageway for flowing out of this space. This flow from the vent valve 16 up and around the chime 13 is shown by arrows at the upper right hand portion of FIG. 2 and by arrows A in FIG. 7.

Although the invention has been described in considerable detail, it will be apparent that the invention is capable of numerous modifications and variations, apparent to those skilled in the art, without departing from the spirit and scope of the invention.

What is claimed is:

1. A can containing a food product which creates a gas buildup, the top of the can comprising a flexible lid having a vent valve to vent built-up gases, an overcap covering the lid and engaging the sides of the can around the periphery thereof, the overcap including a spacing structure inward from an inner edge of the periphery which prevents the vent value from being blocked by the overcap when the lid is pushed toward the overcap by gases built-up within the can.

2. A can according to claim 1, said spacing structure comprising a plurality of bosses on the overcap positioned to be engaged by the flexible lid to block further upward movement thereof, and to allow gases passing through the vent valve to flow toward the periphery of the can.

3. A can according to claim 2, wherein the bosses are positioned to engage the vent valve without occluding gas flow therethrough.

4. A can according to claim 3, wherein there are three bosses which are arranged equiangularly about the center of the overcap.

5. A can according to claim 4, wherein the bosses, viewed in plan view, are thin ribs extending along radii of the overcap.

6. A can according to claim 4, wherein the bosses are, in plan view, rectangular.

7. A can according to claim 1, wherein the spacing structure comprises a pocket formed in the bottom of the overcap which is of sufficient depth to allow the flexible lid to reach a maximum height of the lid caused by the gas buildup without the flexible lid or the vent valve engaging the overcap.

8. A can according to claim 1, wherein the product is ground roast coffee.

9. A can according to claim 1, including a permanently opened passageway from the space between the lid and overcap around the top rim of the can to the exterior.

10. A can according to claim 9, said passageway being formed between raised bosses formed in the overcap where the overcap engages the top rim of the can.

11. A can according to claim 1, wherein the lid does not contact the overcap to block the valve from opening when gases build up within the can.

12. The can of claim 1, wherein the flexible lid is a peelable lid.

13. The can of claim 1, wherein the flexible lid comprises flexible foil.

14. A can containing a food product which creates a gas buildup, the top of the can comprising a flexible lid having a vent valve to vent built-up gases and a chime around the periphery of the top, an overcap covering the lid, and a lower portion extending down along the sides of the can and engaging the sides of the can around the periphery thereof, and including a permanently opened passageway from the space between the lid and the overcap to the exterior, said passageway extending over the chime and down inside the lower portion of the overcap to empty out along the side of the can, said passageway being formed between raised bosses formed in the overcap which engage the top rim of the can.

15. A can containing roast ground coffee packed at atmospheric pressure and generating a carbon dioxide gas buildup, a flexible lid hermetically sealing the top of the can and including a vent valve allowing the escape of built-up carbon dioxide, and an overcap covering the top of the can and engaging the can around the upper rim thereof, the overcap including a spacing structure inward from an inner edge of the rim which prevents the vent valve from being blocked by the overcap when the lid is pushed up toward the overcap by the pressure of the built-up carbon dioxide.

16. A can according to claim 15, said spacing structure comprising a plurality of bosses on the overcap positioned to be engaged by the flexible lid to block further upward movement thereof, and to allow gases passing through the vent valve to flow toward the periphery of the can.

17. A can according to claim 16, wherein the bosses are positioned to engage the vent valve without occluding the flow of carbon dioxide therethrough.

18. A can according to claim 17, wherein there are three bosses which are arranged equiangularly about the center of the overcap.

19. A can according to claim 18, wherein the bosses, viewed in plan view, are thin ribs extending along the radii of the overcap.

20. A can according to claim 18, wherein the bosses are, in plan view, rectangular.

21. A can according to claim 15, wherein the spacing structure comprises a pocket formed in the bottom of the overcap which is of sufficient depth to allow the flexible lid to reach a maximum height of the lid as caused by the carbon dioxide buildup without the flexible lid or the vent valve engaging the overcap.

22. A can according to claim 15, including a permanently opened passageway from the space between the lid and overcap around the top rim of the can to the exterior.

23. A can containing a food product which creates a gas buildup, the top of the can comprising a flexible lid having a vent valve to vent built-up gases, an overcap covering the lid and engaging the sides of the can around the periphery thereof, the overcap including a spacing structure which prevents the vent valve from being blocked by the overcap when the lid is pushed toward the overcap by gases built-up within the can, said spacing structure being positioned such that said spacing structure is not engaged by the valve when the lid is pushed toward the overcap by the gases built-up within the can.

24. A can according to claim 23, wherein the spacing structure is circular.

25. A can according to claim 23, wherein the product is ground roast coffee.

* * * * *